US007795514B2

(12) United States Patent
Kim

(10) Patent No.: US 7,795,514 B2
(45) Date of Patent: Sep. 14, 2010

(54) GUITAR HAVING CHEST AND ARM RESTS AND METHOD OF MANUFACTURING SAME

(76) Inventor: Jong Hoon Kim, #1907 Daerim Acrotel, 467-6, Dogok-dong, Gangnam-gu, Seoul (KR) 135-971

( * ) Notice: Subject to any disclaimer, the term of this patent is extended or adjusted under 35 U.S.C. 154(b) by 0 days.

(21) Appl. No.: 12/365,581

(22) Filed: Feb. 4, 2009

(65) Prior Publication Data

US 2010/0037748 A1 Feb. 18, 2010

(30) Foreign Application Priority Data

Aug. 12, 2008 (KR) ..... 10-2008-0078949

(51) Int. Cl.
*G10D 13/02* (2006.01)

(52) U.S. Cl. ..... 84/267; 84/290

(58) Field of Classification Search ..... 84/267, 84/290, 291

See application file for complete search history.

(56) References Cited

U.S. PATENT DOCUMENTS

| | | | | |
|---|---|---|---|---|
| 6,624,346 | B2 * | 9/2003 | Standish | 84/280 |
| 7,169,991 | B2 * | 1/2007 | Ralbovsky | 84/291 |
| 2007/0044633 | A1 * | 3/2007 | Gregory | 84/327 |

FOREIGN PATENT DOCUMENTS

| | | |
|---|---|---|
| KR | 1019820001695 B1 | 9/1982 |
| KR | 200399201 | 10/2005 |

* cited by examiner

*Primary Examiner*—Kimberly R Lockett
(74) *Attorney, Agent, or Firm*—Grant D. Kang; Kang Intellectual Property Law, LLC

(57) ABSTRACT

Disclosed herein is a guitar, which includes a chest rest formed on a back plate of a main body so that the guitar can be gripped in a stable manner and can be played with a comfort of chest. The guitar further includes an arm rest formed on a top plate of the main body so that so that the guitar can be gripped in a stable manner and can be played with a comfort of chest and arm. A method of manufacturing the chest and arm rest is also disclosed.

4 Claims, 2 Drawing Sheets

(a)

(b)

GUITAR HAVING CHEST AND ARM RESTS AND METHOD OF MANUFACTURING SAME

CROSS-REFERENCE TO RELATED APPLICATIONS

This application claims priority to Korean Patent Application No. 10-2008-0078949, filed on Aug. 12, 2008.

BACKGROUND OF THE INVENTION

1. Field of the Invention

The present invention relates to a guitar having chest and arm rests and a method of manufacturing the same, and in more particular, to a guitar having chest and arm rests and a method of manufacturing the same which can be gripped in a stable manner and with comfort of chest and arm, when playing the guitar.

2. Background of the Related Art

In general, a guitar is one of musical instruments which are familiar and close to our everyday life, and is not very expensive and can be easily played, thereby having become very popular. Such a guitar is comprised of a main body, a neck connected with the main body and having a desired length, a head formed in the end portion of the neck, and guitar strings.

The main body includes a top plate, a back plate and a lateral plate. When the guitar is played, the edge of the back plate rests on the chest of the player, and the right arm rests on the edge of the top plate. Thus, when the player plays the guitar for a long period of time, his or her chest and arm hurt and are swollen in red.

Considering these problems, a guitar having an arm rest has been proposed. However, this guitar still exerts a pressure on the chest and causes the following disadvantages.

FIG. 1 is a perspective view showing the manufacturing procedures for forming an arm rest 6 in the above conventional guitar. As illustrated in FIG. 1*a*, during the manufacturing of the main body 1, first a wood block 5 is inserted into inside of the portion where an arm rest 6 is formed. The top plate 2, lateral plate 3 and back plate 4 are fixed to the wood block 5 and then the main body 1 is completed.

Thereafter, the connection portion 7 between the top plate 2 and the lateral plate 7, where the wood block 5 is inserted, is cut into a desired shape. Finally, the cut portion is painted and finished with a binding.

However, this method of forming an arm rest results in a complicated process and an increase in the material and manufacturing cost. Further, one side of the guitar becomes heavier than others, thereby leading to un-balance of the guitar and increase the pressure being exerted on the chest.

SUMMARY OF THE INVENTION

Accordingly, the present invention has been made in view of the above-mentioned problems occurring in the prior art, and it is a primary object of the present invention to provide a guitar having chest and arm rests and a method of manufacturing the same, which can be gripped in a stable manner and with comfort of chest and arm, when playing the guitar.

To accomplish the above object of the present invention, according to one aspect of the present invention, there is provided a guitar comprising a chest rest formed on a back plate of a main body so that the guitar can be gripped in a stable manner and can be played with a comfort of chest.

In an embodiment, the guitar may further comprise an arm rest formed on a top plate of the main body so that so that the guitar can be gripped in a stable manner and can be played with a comfort of chest and arm.

According to another aspect of the invention, there is provided a method of forming a chest rest in a guitar, the method comprising the steps of: prepare a metallic die for fabricating a guitar main body, the metallic die including a pair of fixed die and mobile die; pressing a material for a back plate of the main body using the metallic die to form a back plate having a curved portion of desired shape formed in a desired place; and forming a depressed portion in a lateral plate of the main body so as to correspond to an end portion of the curved portion; and bonding the back plate and the lateral plate to each other to form a chest rest.

According to another aspect of the invention, there is provided a guitar main body having a chest rest manufactured by the above method.

According to another aspect of the invention, there is provided a method of forming an arm rest in a guitar, the method comprising the steps of: prepare a metallic die for fabricating a guitar main body, the metallic die including a pair of fixed die and mobile die; pressing a material for a top plate of the main body using the metallic die to form a top plate having a curved portion of desired shape formed in a desired place; and forming a depressed portion in a lateral plate of the main body so as to correspond to an end portion of the curved portion; and bonding the top plate and the lateral plate to each other to form an arm rest.

According to another aspect of the invention, there is provided a guitar main body having an arm rest manufactured by the above.

As described above, a guitar according to the present invention is provided with a chest rest formed on the back plate of the main body and with an arm rest formed on the top plate of the main body. Therefore, when playing the guitar, the guitar can be gripped in a stable manner and with comfort of chest and arm, when playing the guitar.

Further, the chest and arm rests are formed by pressing materials for the top and back plates of the main body. Formation of the chest and arm rests can be simplified, and materials and cost can be reduced. The guitar can become lighter and be balanced over the entire baby.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, the preferred embodiments of the present invention will be described in detail with reference to the accompanying drawings.

Figure 1:
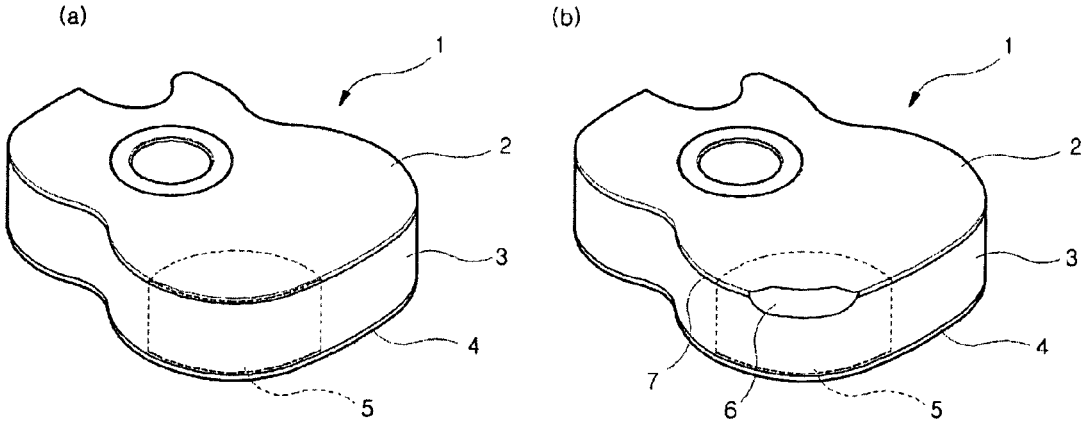
FIG. 1 is a perspective view showing the manufacturing procedures for forming an arm rest in a conventional guitar.
Figure 2:
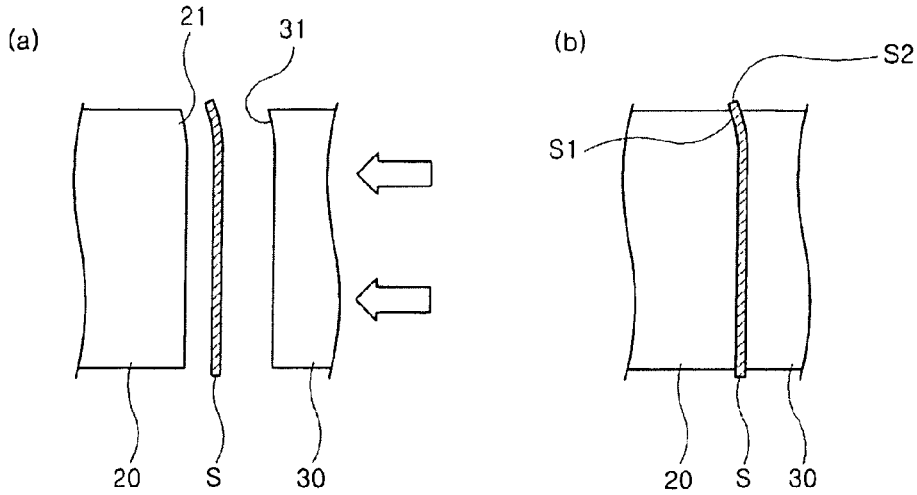
FIG. 2 explains a method of forming a curved portion in a material for a guitar body according to an embodiment of the invention.
Figure 3:
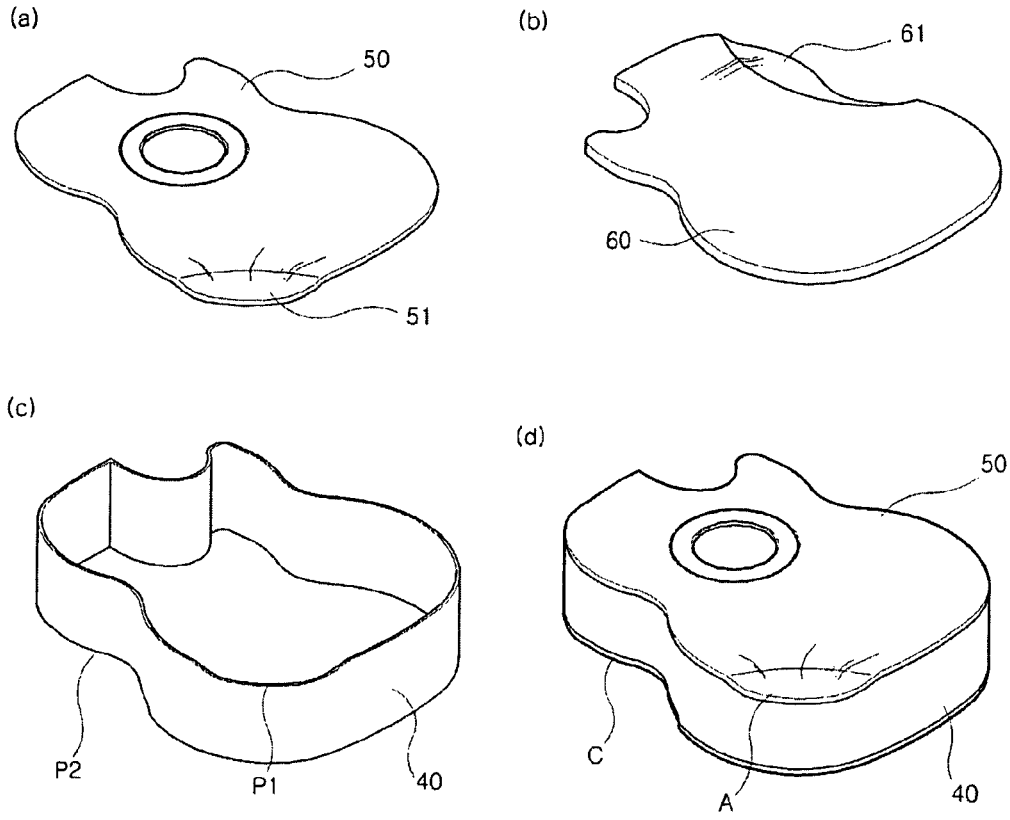
FIG. 3 are perspective views showing a top plate, a back plate, a lateral plate and a completed main body of a guitar according to an embodiment of the invention.

FIG. 1 is a perspective view showing the manufacturing procedures for forming an arm rest 6 in a conventional guitar. FIG. 2 explains a method of forming a curved portion S1 in a material S for a guitar body according to an embodiment of the invention. FIG. 3 are perspective views showing a top plate 50 (FIG. 3*a*), a back plate 60 (FIG. 3*b*), a lateral plate 40 (FIG. 3*c*) and a completed main body of a guitar (FIG. 3*d*) according to an embodiment of the invention.

According to an embodiment of the invention, a chest rest C (FIG. 3*d*) or 61 (FIG. 3*b*) is formed in the back plate 60 of a guitar main body. As shown, the chest rest C or 61 is a recessed portion of the back plate 60. An arm rest A (FIG. 3*d*) or 51 (FIG. 3*a*) is formed in the top plate 50 of the main body. As shown, the arm rest A or 51 is a recessed portion of the top plate 50. In order to form the chest and arm rests C, A, first, a metallic die 20, 30 for fabrication the main body is prepared, which is comprised of a fixed die 20 and a mobile die 30. Formed in the upper portion of the fixed die 20 is a curved portion 21 having a desired shape. Formed in the upper portion of the mobile die 30 is a protrusion having an internal curved face 31, which corresponds to the curved portion 21 of the fixed die 20.

A material S for the top plate 50 or back plate 60 is inserted between the fixed die 20 and the mobile die 30. Then, the mobile die 30 is pressed toward the fixed die 20 to thereby form a curved portion S1 in the top portion thereof.

On the other hand, formed in the lateral plate 40 of the main body are depressions P1 and P2, which are corresponding to the curved portion S1 of the top plate 50 and the back plate 60 respectively. These lateral plate 40, top plate 50 and back plate 60 are bonded into an integral form to complete the main body formed with an arm rest A and a chest rest C.

As described above, a guitar according to the present invention is provided with a chest rest formed on the back plate of the main body and with an arm rest formed on the top plate of the main body. Therefore, when playing the guitar, the guitar can be gripped in a stable manner and with comfort of chest and arm, when playing the guitar.

Further, the chest and arm rests C, A are formed by pressing materials S for the top and back plates 50, 60 of the main body. Formation of the chest and arm rests C, A can be simplified, and materials and cost can be reduced. The guitar can become lighter and be balanced over the entire baby.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A guitar comprising a chest rest formed in a back plate of a main body so that the guitar can be gripped in a stable manner and can be played with a comfort of chest;

wherein said chest rest comprises a recessed portion of said back plate; and wherein the chest rest is manufactured by a method comprising the steps of:

preparing a metallic die for fabricating the main body, the metallic die including a pair of fixed die and mobile die;

pressing a material for the back plate of the main body using the metallic die to form the back plate having a curved portion of desired shape formed in a desired place; and forming a depressed portion in a lateral plate of the main body so as to correspond to an end portion of the curved portion; and bonding the back plate and the lateral plate to each other to form the chest rest.

2. The guitar according to claim 1, further comprising an arm rest formed in a top plate of the main body so that so that the guitar can be gripped in a stable manner and can be played with a comfort of chest and arm.

3. A method of forming a chest rest in a guitar, the method comprising the steps of:

preparing a metallic die for fabricating a guitar main body, the metallic die including a pair of fixed die and mobile die;

pressing a material for a back plate of the main body using the metallic die to form a back plate having a curved portion of desired shape formed in a desired place; and forming a depressed portion in a lateral plate of the main body so as to correspond to an end portion of the curved portion; and bonding the back plate and the lateral plate to each other to form a chest rest.

4. A method of forming an arm rest in a guitar, the method comprising the steps of:

preparing a metallic die for fabricating a guitar main body, the metallic die including a pair of fixed die and mobile die;

pressing a material for a top plate of the main body using the metallic die to form a top plate having a curved portion of desired shape formed in a desired place; and forming a depressed portion in a lateral plate of the main body so as to correspond to an end portion of the curved portion; and bonding the top plate and the lateral plate to each other to form an arm rest.

* * * * *